United States Patent [19]

Kaltenbach

[11] 4,285,290

[45] Aug. 25, 1981

[54] MODULAR WORK TRIMMER FOR A SEWING MACHINE

[75] Inventor: Kenneth F. Kaltenbach, Leonia, N.J.

[73] Assignee: The Singer Company, Stamford, Conn.

[21] Appl. No.: 71,156

[22] Filed: Aug. 30, 1979

[51] Int. Cl.[3] ..... D05B 37/00

[52] U.S. Cl. ..... 112/125

[58] Field of Search ..... 112/129, 122, 125, 123

[56] References Cited

U.S. PATENT DOCUMENTS

| | | | |
|---|---|---|---|
| 1,426,460 | 8/1922 | DeVoe | 112/125 |
| 2,202,599 | 5/1940 | Pinkvoss | 112/125 |
| 2,308,470 | 1/1943 | Parry | 112/125 |
| 2,790,332 | 4/1957 | Caster et al. | 74/571 |
| 2,790,405 | 4/1957 | Graham | 112/123 |
| 2,893,335 | 7/1959 | Benink et al. | 112/125 |
| 3,074,363 | 1/1963 | Gross et al. | 112/125 |
| 3,366,084 | 1/1968 | Patrick et al. | 112/256 |

FOREIGN PATENT DOCUMENTS

| | | | |
|---|---|---|---|
| 646339 | 9/1962 | Italy | 112/125 |
| 29480 | of 1913 | United Kingdom | 112/125 |

*Primary Examiner*—Ronald Feldbaum

*Attorney, Agent, or Firm*—William V. Ebs; Robert E. Smith; Edward L. Bell

[57] ABSTRACT

Work trimmer mechanism is provided for a sewing machine in a module including a frame securable on the machine, a split eccentric securable on the arm shaft, a split bearing securable about the eccentric, a link reciprocable by the bearing during rotation of the arm shaft, linkage means mounted on the frame and actuable by the linkage means, and a trimmer knife carrier operable by the linkage means.

9 Claims, 8 Drawing Figures

MODULAR WORK TRIMMER FOR A SEWING MACHINE

BACKGROUND OF THE INVENTION

1. Field of the Invention

The invention relates to trimmer mechanism for a sewing machine, and is particularly directed to a novel construction for a modular sewing machine attachment including trimmer mechanism.

2. Description of the Prior Art

Various types of sewing machines with trimming mechanism adjacent the needle to cut a work piece at about the same time that it is being sewn have been available for sometime. Such trimming mechanisms have been factory installed, and it has not been possible to purchase a machine which is without a trimmer and to which a trimmer could be conveniently added by a purchaser at a later time. The present invention overcomes the problem by providing a modular work trimmer which can be readily mounted on a sewing machine by the owner after the machine has left the manufacturer's factory. A prospective purchaser is thereby afforded, the opportunity of acquiring a machine without a trimmer, and, later when the need arises, or funds become available, adding the trimming mechanism.

SUMMARY OF THE INVENTION

In accordance with the invention, a work trimmer module is constructed for ready attachment to a sewing machine having a driving arm shaft within a hollow bracket arm which includes an opening at the rear of the machine permitting access to the arm shaft. The module includes a frame securable to the machine and having an opening therein which communicates with the opening in the arm when the frame is secured thereon. Such module further includes a split eccentric securable on the arm shaft, a split bearing securable about the eccentric, a member reciprocable by the bearing during rotation of the arm shaft and operable through said openings, linkage means mounted on the frame outside the sewing machine bracket arm and removably connected with said reciprocable member, and a trimmer knife carrier connected with the linkage means for actuation thereby in response to reciprocation of the reciprocable member. The linkage means through which motion is transmittable to the trimmer knife carrier includes a snap action toggle mechanism which an operator can employ to initiate or discontinue a cloth cutting operation.

DESCRIPTION OF THE PREFERRED EMBODIMENT

Figures 1, 7:
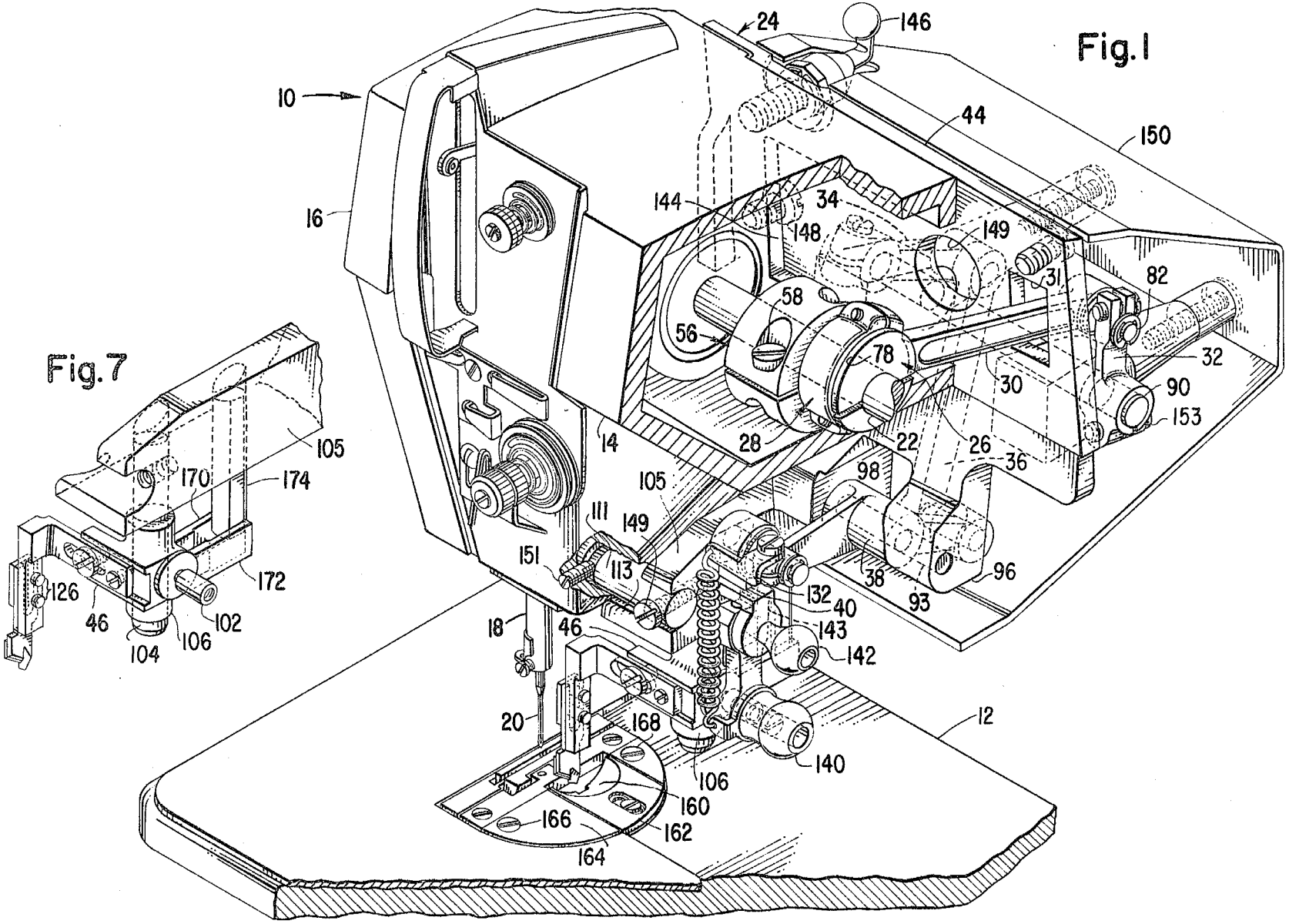
FIG. 1 is a perspective view of part of a sewing machine equipped with the cloth trimming modular attachment of the invention and having portions broken away to show mechanism of the module.
FIG. 7 is a fragmentary perspective view showing the knife carrier and associated portions of the modular trimmer.
Figure 2:
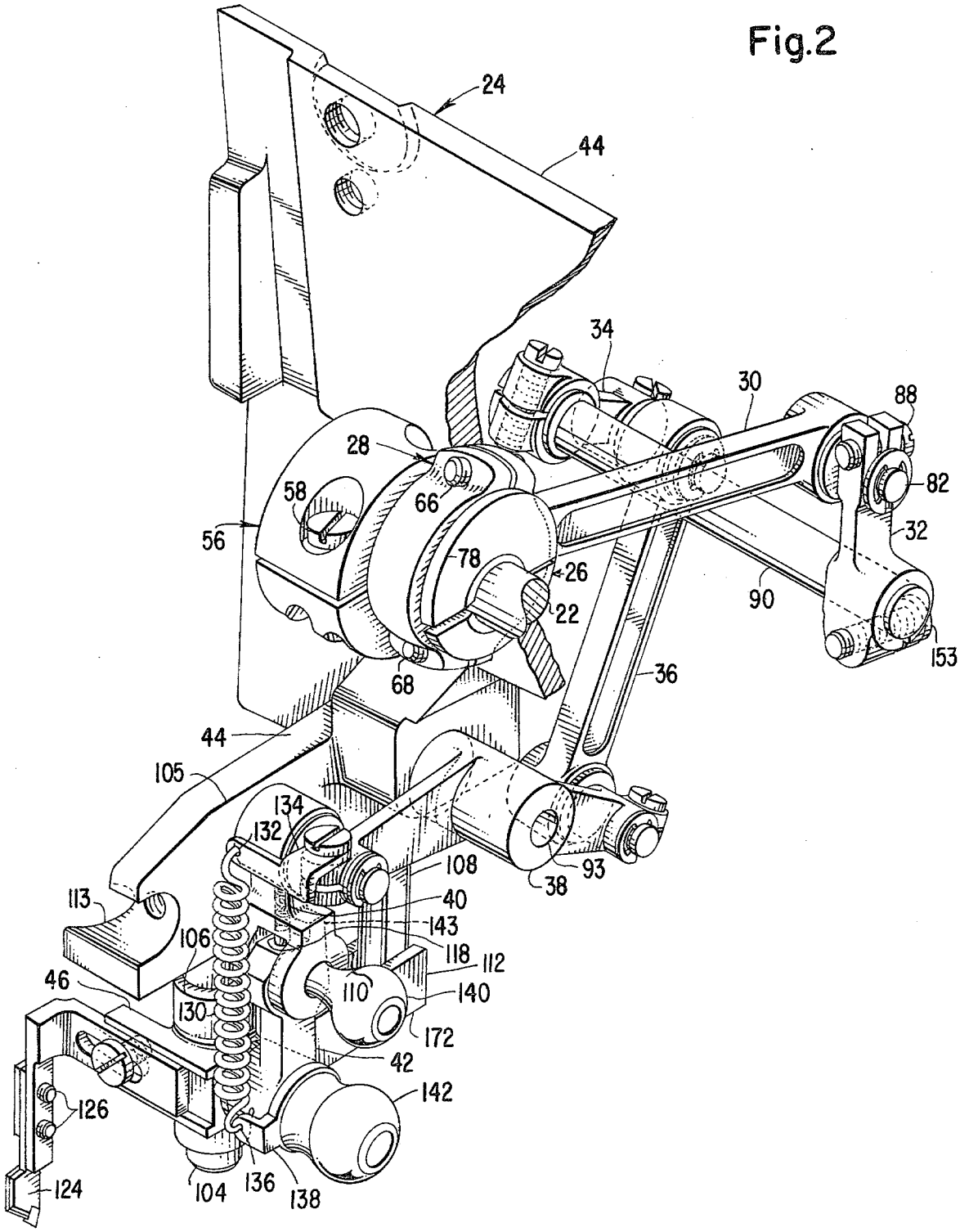
FIG. 2 is an enlarged perspective view showing the modular attachment of the invention.
Figure 3:
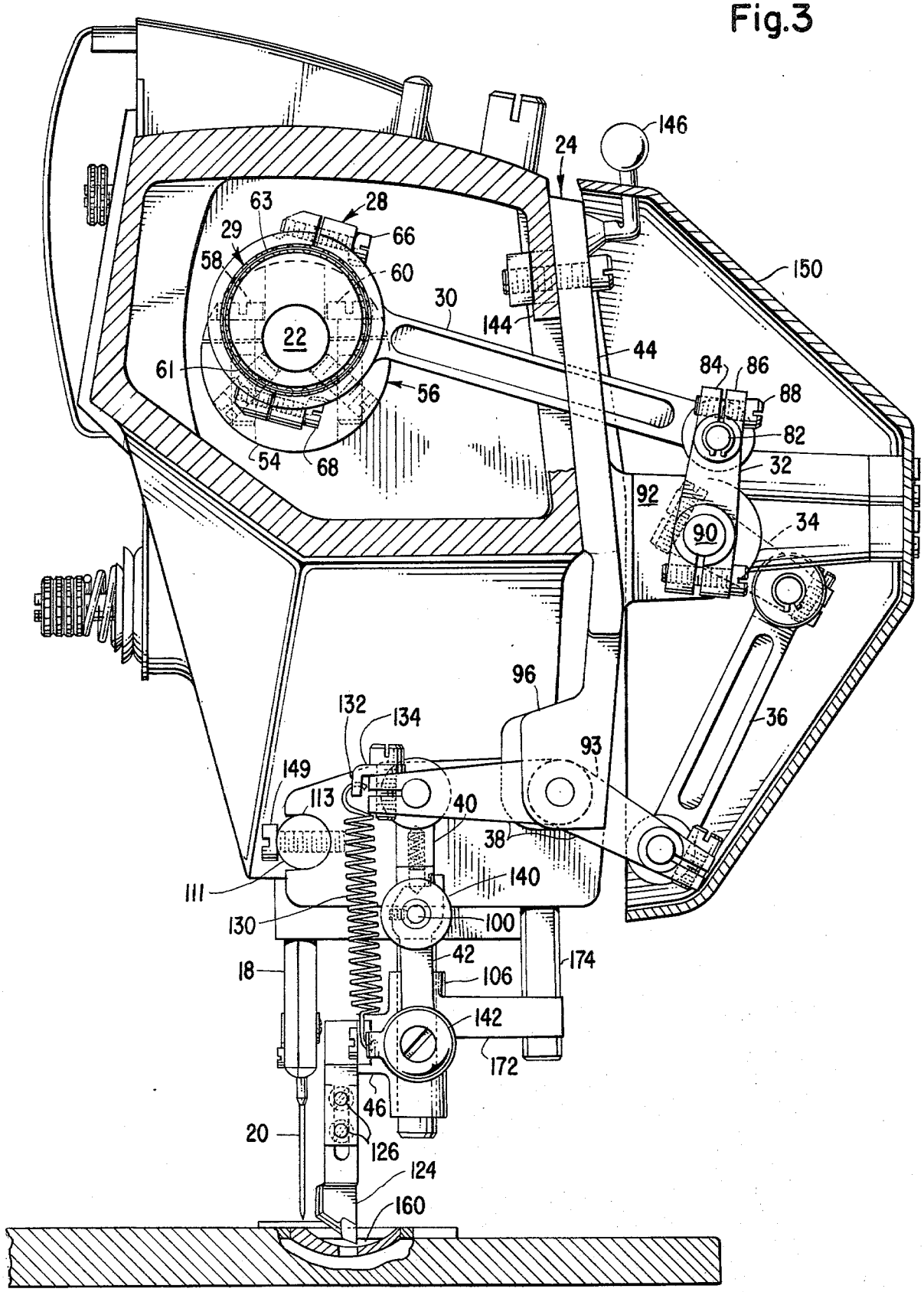
FIG. 3 is an end view partially in section of the sewing machine of FIG. 1 with the cloth trimming module thereon.
Figure 4:
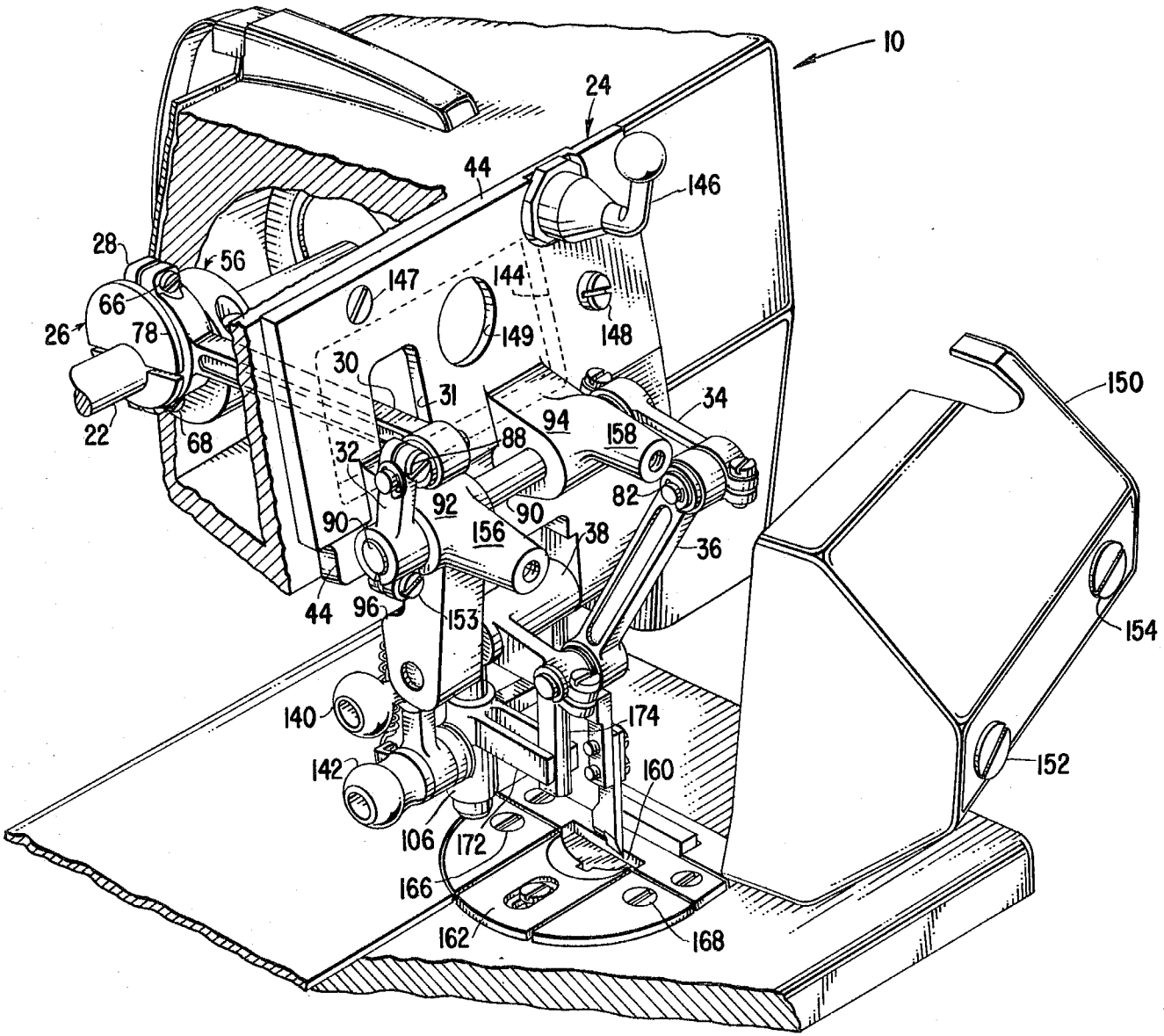
FIG. 4 is a rear view of the sewing machine portion of FIG. 1 showing the cloth trimming module with its cover removed.
Figure 5:
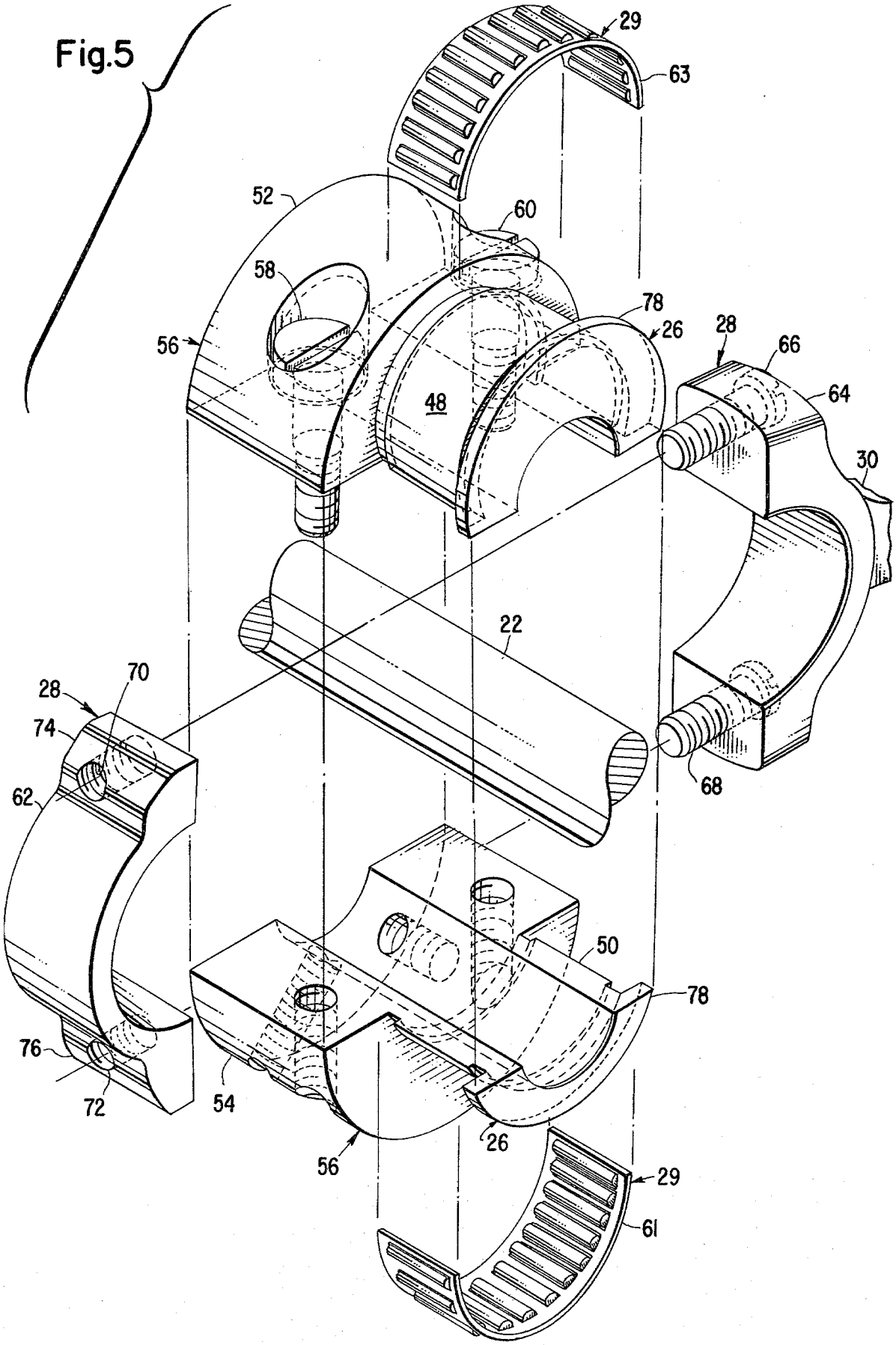
FIG. 5 is an enlarged exploded perspective view of a bearing, race, and eccentric by means of which the modular trimming mechanism is operably connected to the sewing machine arm shaft.

Referring to FIG. 1 of the drawings showing a portion of a sewing machine 10, there may be seen a part of the bed 12 of the machine, and part of an overhanging hollow bracket arm 14, terminating in a sewing head 16. The machine is to be understood as including a standard, not shown, on which the bracket arm 14 is supported over the bed 12. Mounted in the sewing head 16 for endwise reciprocation as is well known in the sewing machine art is a needle bar 18 terminating in a sewing needle 20 which cooperates with a rotating loop taker (not shown) in the bed during the formation of stitches. Not shown in FIG. 1 is the feed system and feed dogs in the bed for urging work material in a selected direction, forward or reverse, intermittent to the penetration of the work by the sewing needle 20. Also not shown are means for driving mechanism in the sewing head operable to impart reciprocatory motion to the needle bar, or for driving mechanism in the bed operable to rotate the loop taker and actuate the feed dog; except, however, for arm shaft 22 which is located within bracket arm 14 and drives the needle reciprocating mechanism in the sewing head.

In accordance with the invention, there is provided a trimmer module 24 for use on the sewing machine 10. Such module (see FIGS. 1 through 5) includes a split eccentric 26, a split bearing and split ball bearing race 28 and 29 respectively, a member 30 connected to the bearing for reciprocation thereby, a linkage system including links 32, 34, 36, 38, 40 and 42 which are operably connected to and actuable by the reciprocable member 30, a frame 44 which supports the linkage system and which may be readily attached to the sewing machine 10, and a trimmer knife carrier 46 which is mounted on the frame 44 and operated by the linkage system.

The split eccentric 26 includes complementary parts 48 and 50 which are integral with parts 52 and 54 respectively, that together define a hub 56 securable on the arm shaft 22 of machine 10 with screws 58 and 60. The split bearing 28 is comprised of bearing parts 62 and 64 which are securable along with race parts 61 and 63 over the eccentric 26 with threaded fastners 66 and 68 extending into holes 70 and 72 in ears 74 and 76 on the bearing parts. A flange 78 on the eccentric 26 and the hub 56 confine the bearing axially when on the eccentric parts. Bearing part 64 is integral with one end of reciprocable member 30 and such member 30 extends from the bearing part 64 through an elongated opening 31 in frame 44 to pivotally connect with a pin 82 secured for easy removal between bifurcated end portions 84 and 86 of link 32 by a screw 88.

Link 32 is affixed at the end opposite bifurcated portions 84 and 86 to a shaft 90 mounted for rotational movements in bosses 92 and 94 which are integral parts of the frame 44. Link 34 is also affixed at one end to shaft 90. The opposite end of link 34 is pivotally connected to one end of link 36 which is further connected at its other end for pivotal movement to one end of link 38. The opposite end of link 38 is pivotally connected to link 40, and between its ends the link 38 is pivotally mounted on a shaft 93 which is affixed in portions 96 and 98 of frame 44.

Link 40 extends from its pivotal connection with link 38 to pivot pin 100 where it is connected to one end of link 42. The opposite end of link 42 is pivotally connected to a pin 102 which is affixed in trimmer knife carrier 46. The carrier 46 is slidable upon a shaft 104 which is affixed in an arm 105 of frame 44 and extends through a boss 106 on the carrier, and upon a member 108 affixed in the arm 105 and extending between bifurcated portions 110 and 112 of the carrier.

Figure 6A:
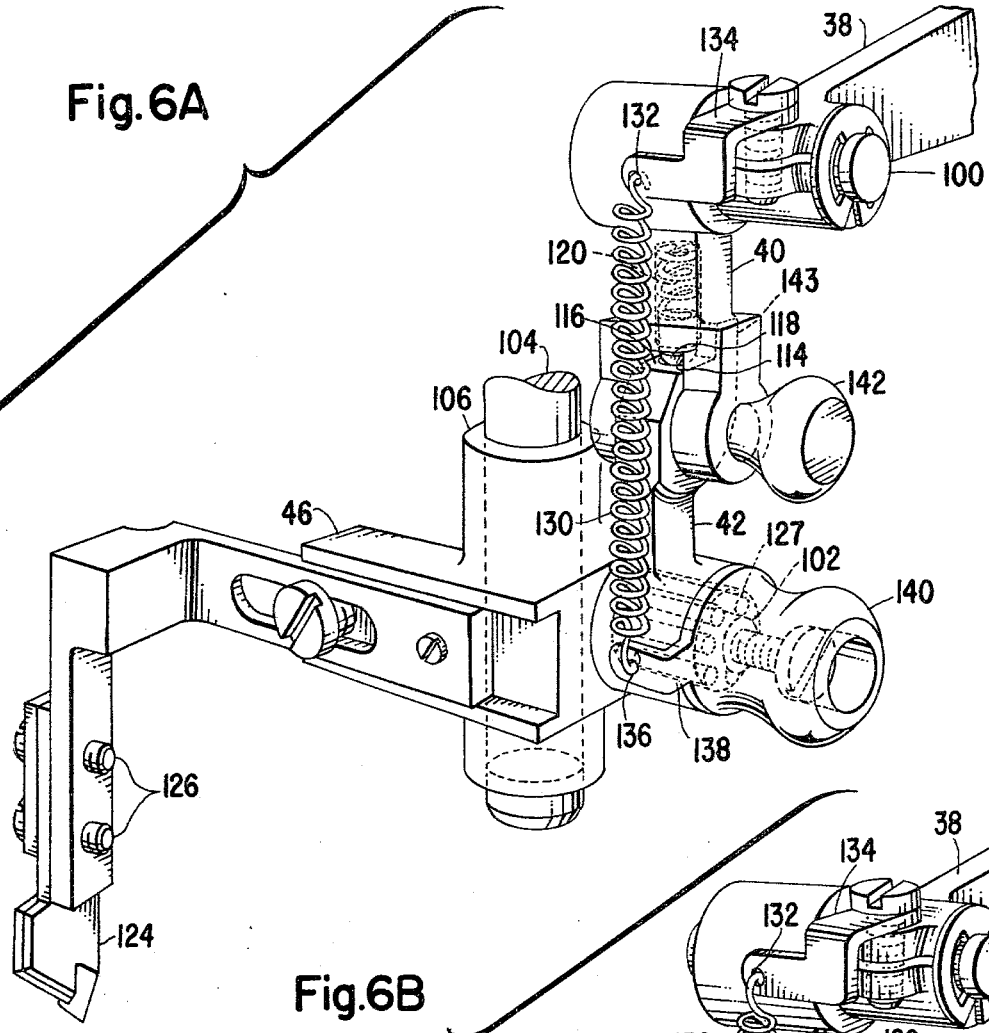
FIG. 6A is an enlarged perspective view showing toggle mechanism of the modular trimmer in a locked position.
Figure 6B:
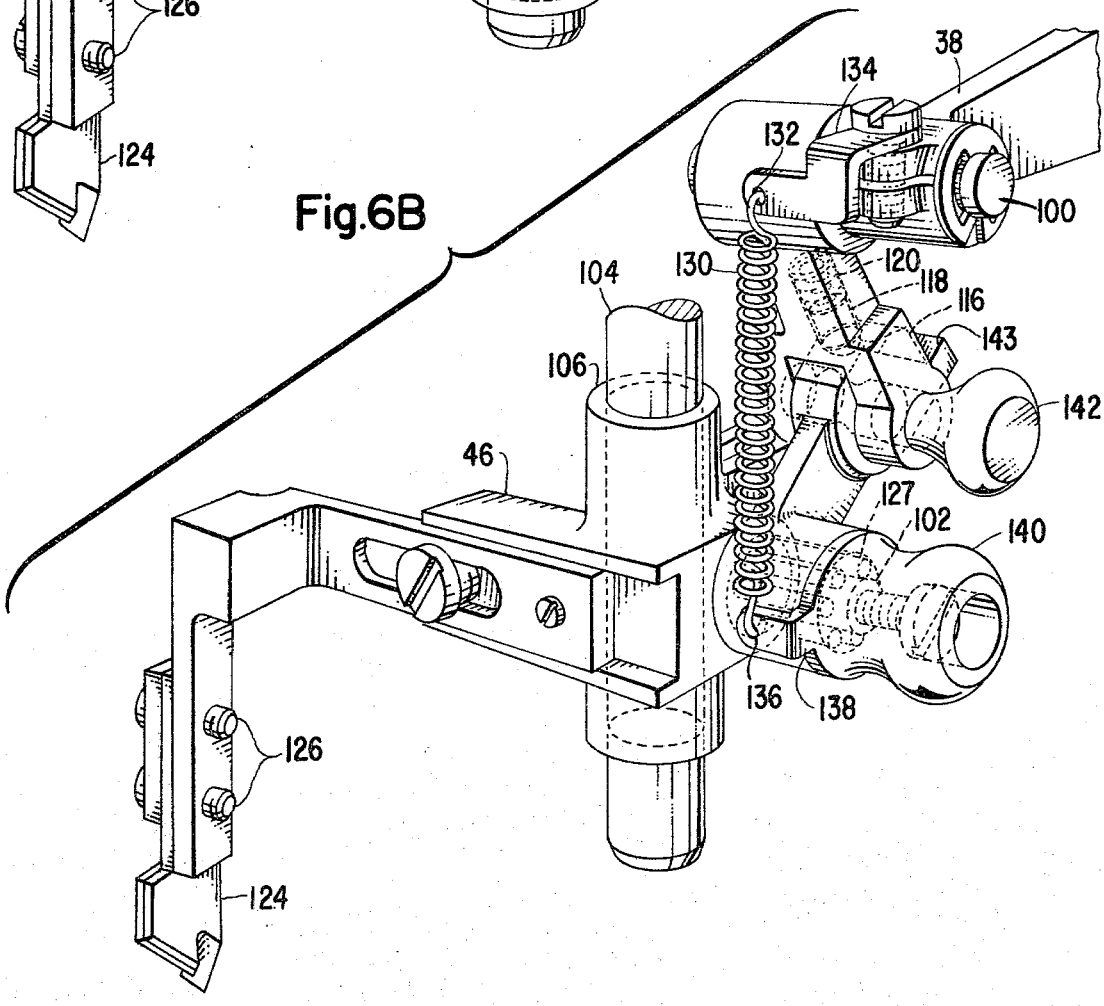
FIG. 6B is an enlarged perspective view showing the toggle mechanism unlocked.

Links 40 and 42 are part of a toggle mechanism which also includes a recess 114 in an end planar surface 116 on link 42, and a pin 118 that is biased by a spring 120 in link 40 against link 42. The pin 118 is caused to enter the recess 116 when the links are aligned (FIG. 6A). The links are then effectively locked to transmit motion as a unit to carrier 46 and thereby to knife 124 affixed to the carrier as at 126. The toggle mechanism unlocks when the links are moved off center rearwardly, and when the mechanism is unlocked the link 42 can only pivot on roller bearing 127 surrounding the pin 102 without transmitting motion to the carrier which is then held against arm 105 of the frame by a spring 130 having one end connected at 132 to a tab 134 on link 38 and the other end connected at 136 to a tab 138 on link 42. Knobs 140 and 142 are provided on pins 100 and 102 respectively, as shown, to serve as convenient pressure points for the fingers of an operator wishing to lock or unlock the toggle mechanism. A step 143 on link 40 prevents the toggle from being moved forwardly off center.

When the trimmer module 24 is to be attached to the sewing machine 10, a mounting pin 111 is positioned in the machine to engage and support frame 44 in a cradle 113 located at the end of arm 105. However, before the frame is mounted on the machine, member 30 is disconnected from link 32 by loosening screw 88 and sliding pin 82 out of the end of member 30. Member 30 is then removed from the module through elongated opening 31. Eccentric 26 and bearing 28 are disassembled, and then reassembled on the arm shaft 22, the reassembly being performed through a rectangular bracket arm opening 144 suitable for the purpose. The eccentric is temporarily permitted to float freely on the arm shaft by leaving screws 58 and 60 loose in the hub parts 52 and 54 which are integral with the complementary eccentric parts 48 and 50. Member 30 is guided through elongated opening 31 in the frame 44, and the frame is mounted on pin 111 at cradle 113 and secured to the machine structure with clamp 146 and screws 147 and 148. The frame is also secured to pin 111 with a screw 149 and thereafter a set screw 151 in the machine structure is tightened against the pin 111.

After the frame 44 has been affixed on the machine, pivot pin 82 is reinserted and locked in place in member 30 to reconnect the member to link 32. The arm shaft 22 is rotated in its normal direction of rotation with the handwheel (not shown) of the machine until the needle bar is at the bottom of its stroke, and radial timing of the eccentric is established by tightening the screws 58 and 60 through a hole 149 in frame 44 with a screw driver after the hub 56 has been first urged with the screw driver or other suitable tool into a prescribed position wherein one of the screws 58 and 60 is in alignment with hole 149. The stroke of knife 124 is then timed by rotating the arm shaft 22 until the knife 124 is at the bottom of its stroke, loosening link 32 on shaft 90 with screw 153, moving knife carrier 46 to a prescribed position above the bottom end of shaft 104 while the toggle mechanism is locked, and then reclamping link 32 to shaft 90 with the screw 153.

Finally a cover 150 is secured over the linkage system with screws 152 and 154 extending through the cover and into posts 156 and 158 which are integral parts of the frame 44.

When the sewing machine 10 is in operation and arm shaft 22 is rotating, member 30 is reciprocated by the action of eccentric 26 and reciprocatory motion is successively imparted to links 32, 34, 36, 38 and 40 of the linkage system. Assuming the toggle mechanism including links 40 and 42 is locked, link 42 is vertically reciprocated along with link 40 and carrier 46 is vertically reciprocated with knife 124 in timed relation to reciprocation of the sewing needle 20. Any cloth being then passed under the knife 124 during a sewing operation is cut by the knife as it repeatedly descends into a recess 160 in an adjustable plate 162 which is mounted in a throat plate 164 that is affixed in the bed 12 by screws 166 and 168. Cutting operations may be discontinued as indicated hereinbefore, that is by unlocking the toggle mechanism to thereby cause the knife to be drawn upwards away from the work by the knife carrier 46 and the reciprocatory action of the carrier to be discontinued.

Numerous alterations of the structure herein disclosed will suggest themselves to those skilled in the art, however, it is to be understood that the present disclosure relates to a preferred embodiment of the invention which is for purposes of illustration only and not to be construed as a limitation thereof. All such modifications which do not depart from the spirit of the invention are intended to be included within the scope of the appended claims.

I claim:

1. A work trimmer module for a sewing machine having a driving arm shaft within a hollow bracket arm which extends above the bed of the machine and includes an opening at the rear of the machine permitting access to the arm shaft, said module comprising a frame securable to the machine and including an opening which communicates with the opening in the arm when the frame is secured thereon, a split eccentric securable on the arm shaft, a split bearing securable about the eccentric, a member reciprocable by said bearing during rotation of the arm shaft and operable through the said openings, linkage means mounted on the frame outside said bracket arm and removably connected with said reciprocable link, a trimmer knife carrier operably connected with said linkage means for movement thereby at least at times in response to the reciprocation of said reciprocable link, and a knife actuable by said carrier.

2. The combination of claim 1 wherein the split eccentric includes at least two parts each of which is integral with a hub portion, and means are provided for securing the hub portions and thereby the split eccentric parts on the arm shaft in complementary positions, said split bearing including complementary parts adapted to receive fastners for securing the bearing parts to each other and around the eccentric.

3. The combination of claim 2 wherein one bearing part is integral with said reciprocable member.

4. The combination of claim 1 wherein the linkage means is removably connected to the reciprocable member at one end of a link which is mounted at the opposite end in the frame for pivotal movement.

5. The combination of claim 1 including a cover secured to said frame and extending over at least portions of the operating mechanism of the module.

6. The combination of claim 1 wherein the linkage means includes portions extending to the rear of the bracket arm, and said combination includes a cover secured to the frame and extending over the said portions of the linkage means.

7. The combination of claim 6 wherein the cover is removably secured to the frame.

8. The combination of claim 1 including a pair of adjacent pivotally connected links in said linkage means and including means for interlocking such links for operation as a motion transmitting unit enabling the operation of said knife carrier by said linkage means, and for unlocking said links to prevent the operation of the knife carrier.

9. The combination of claim 8 including spring means in association with said links for holding the knife carrier in a predetermined position above the bed of the machine when said links are unlocked.

* * * * *